US006892597B2

(12) United States Patent
Tews

(10) Patent No.: US 6,892,597 B2
(45) Date of Patent: May 17, 2005

(54) JOYSTICK

(75) Inventor: Erik Tews, Fresno, CA (US)

(73) Assignee: Pelco, Clovis, CA (US)

( * ) Notice: Subject to any disclaimer, the term of this patent is extended or adjusted under 35 U.S.C. 154(b) by 136 days.

(21) Appl. No.: 10/205,801

(22) Filed: Jul. 25, 2002

(65) Prior Publication Data

US 2003/0019316 A1 Jan. 30, 2003

Related U.S. Application Data

(60) Provisional application No. 60/308,648, filed on Jul. 27, 2001.

(51) Int. Cl.[7] ..... G05G 1/04

(52) U.S. Cl. ..... 74/471 XY; 273/148 R; 345/161

(58) Field of Search ..... 74/471 XY, 548, 74/555; 200/6 A, 179; 273/148 R; 338/163; 345/161

(56) References Cited

U.S. PATENT DOCUMENTS

| | | | | | |
|---|---|---|---|---|---|
| 2,787,746 | A | * | 4/1957 | Redmond | 318/580 |
| 3,707,093 | A | | 12/1972 | Worden | |
| 4,156,130 | A | | 5/1979 | Ivashin et al. | |
| D271,312 | S | | 11/1983 | Renteria | |
| 4,434,412 | A | | 2/1984 | Ruumpol | |
| 4,533,899 | A | * | 8/1985 | Isaksson | 338/128 |
| 4,825,157 | A | | 4/1989 | Mikan | |
| 4,857,881 | A | | 8/1989 | Hayes | |
| 4,945,357 | A | | 7/1990 | Tal | |
| 5,116,180 | A | * | 5/1992 | Fung et al. | 414/5 |
| 5,142,931 | A | | 9/1992 | Menahem | |
| 5,224,589 | A | * | 7/1993 | Karakama et al. | 200/339 |
| 5,286,024 | A | | 2/1994 | Winblad | |
| 5,436,640 | A | * | 7/1995 | Reeves | 345/161 |
| 5,532,476 | A | | 7/1996 | Mikan | |
| 5,655,411 | A | | 8/1997 | Avitan et al. | |
| 5,710,575 | A | | 1/1998 | Hicok et al. | |
| 5,738,352 | A | | 4/1998 | Ohkubo et al. | |
| 5,749,577 | A | | 5/1998 | Couch et al. | |
| 5,966,991 | A | | 10/1999 | Gosselin et al. | |
| 6,002,388 | A | | 12/1999 | Seffernick et al. | |
| 6,034,669 | A | | 3/2000 | Chiang et al. | |
| 6,059,660 | A | | 5/2000 | Takada et al. | |
| 6,184,865 | B1 | | 2/2001 | Zimmerman et al. | |
| D438,847 | S | | 3/2001 | Hasegawa | |
| 6,276,230 | B1 | * | 8/2001 | Crum et al. | 74/551.9 |
| 6,331,849 | B1 | | 12/2001 | VandenBoom | |
| 6,353,431 | B1 | | 3/2002 | Poole et al. | |
| 6,429,849 | B1 | * | 8/2002 | An et al. | 345/161 |

* cited by examiner

*Primary Examiner*—William C. Joyce
(74) *Attorney, Agent, or Firm*—Gunster, Yoakley & Stewart, P.A.

(57) ABSTRACT

A durable, reliable and comfortable joystick for use in precision applications such as controlling a surveillance camera. The joystick of the present invention incorporates mechanical linkages that convert the user's motion into the rotation of three different resistive potentiometers, one for each of 3 axes of movement (X, Y and Z). The potentiometers and linkages for the X- and Y-axes are incorporated into the joystick base, and the potentiometer and linkage for the Z-axis is uniquely incorporated into the joystick handle. Rotation of the handle is restricted in order to prevent damage to the internal parts and preserve the life of the joystick.

16 Claims, 11 Drawing Sheets

JOYSTICK

This application claims the benefit of U.S. Provisional Application No. 60/308,648 filed Jul. 27, 2001,

BACKGROUND OF THE INVENTION

1. Field of the Invention

The present invention relates to apparatus control, and more particularly to an improved joystick for use in controlling the movement of an apparatus such as a surveillance camera that is extremely durable and that is capable of withstanding considerable operator abuse, while providing comfortable and precise control.

2. Description of the Prior Art

Mouse devices and joystick type controllers are well-known coordinate input devices for computer systems. Joystick devices generally include a rectangularly shaped base from which the joystick shaft protrudes. The shaft may be shifted in an inclined manner in any direction, and an angle detection mechanism is provided in the base to detect the inclined angle and direction along the X and Y axes. The detected angle and direction are then supplied to a computer system. In addition, many joystick devices also provide for rotational movement about the Z-axis by allowing the joystick shaft to be twisted by the user. This rotational or twisting motion about the Z-axis is also detected and transmitted to a computer system. Potentiometers are typically used as the devices for detecting the angle and rotation of the joystick.

Joysticks are widely used in the closed circuit television (CCTV) industry to control the operation and movement of surveillance cameras. An operator monitoring the image from a surveillance camera may desire to move the camera to follow a subject as it moves through the area within the range of the camera. Such tracking typically requires reasonably precise movement of the camera that is accomplished using a computer system that responds to signals generated from an operator controlled joystick. Unexpected movements by the subject being tracked, or a need by the operator to suddenly change the direction of the camera may often result in harsh treatment of the joystick used to control the camera. The useful lives of many existing joysticks are often cut short by such normal operator use (and/or abuse) because the joystick devices are flimsy, poorly constructed, or poorly designed and subject to breakage in a relatively short period of time.

Several joysticks including those described in U.S. Pat. Nos. 4,857,881 and 6,059,660 utilize slotted cross members attached to journals at either end such that the rod of the joystick extends through the slots of each of the cross members. Each of the cross members is attached to a potentiometer. Motion imparted to the joystick along the X-axis imparts rotation to one of the slotted cross members and its associated potentiometer, and motion imparted to the joystick along the Y axis imparts rotation to the other of the slotted cross members and its associated potentiometer. However, neither of such cross members recognizes rotational motion imparted along the Z-axis.

Converting motion imparted along the Z-axis of a joystick has been a particularly troublesome obstacle to joystick design. This is because many existing joysticks cannot withstand excess rotational twisting or turning motion imparted around the Z-axis. Twisting or turning the joystick around the Z-axis is part of the ordinary control it provides. However, even minor over-twisting of a joystick can lead to wrapping and ultimately disconnection of wires leading to the joystick, as well as destruction of, or disconnection of the joystick from the mechanism of cross axes in the joystick base which receive the motion imparted to the joystick by the user. Either situation is unacceptable in that it renders the joystick inoperable. U.S. Pat. No. 6,059,660 begins to address this problem by preventing the joystick shaft from rotating around the Z-axis, and by providing a switch between the joystick handle and the joystick shaft for detecting whether the handle has been rotated using a set of contacts on an intermediate switch. However, there is nothing in this device to prevent unchecked rotation of the joystick handle, and very few contacts are provided on the switch such that considerable rotation around the Z-axis will not be detected at all. Moreover, the contacts themselves do not yield the more precise rotational detection information that can be provided by a potentiometer.

Many existing joysticks such as those described in U.S. Pat. Nos. 3,707,093, 4,825,157, 5,286,024 and 5,738,352 utilize tension springs that are attached to the base or shaft of the joystick. Many such springs are expanded as the joystick is moved. The tension in the spring pulls the joystick back to a "home" position when the joystick is released. Many such tension springs suffer from the drawbacks of being easily disconnected from their supports, and from wearing out after constant use.

Other joysticks have potentiometers that are adjustably mounted with respect to the rotational axes of the base, allowing for fine tuning depending upon the position of the joystick itself. However, after the adjustments have been made, over time the adjustable mounting structures tend to become loose, thereby affecting the signals generated by the potentiometers, and skewing the control of the joystick.

Grease or other lubrication is also required in a number of existing joysticks devices on their lower axes as well as at the bottom of the joystick shaft where it attaches to the support base. Such lubricants may cause problems in that they may spread onto the joystick itself making it greasy, repulsive and difficult to control.

For all of these above reasons, and others, it is desirable to provide a durable, reliable and comfortable joystick that is capable of withstanding substantial rotational motion imparted along the Z-axis without failure, while also providing a high level of precision necessary for use in controlling a surveillance camera, and for other applications requiring similar precision.

SUMMARY OF THE INVENTION

The improved joystick of the present invention provides a durable, reliable and comfortable joystick for use in precision applications such as controlling a surveillance camera. The joystick of the present invention incorporates mechanical linkages that convert the user's motion into the rotation of three different resistive potentiometers, one for each of 3 axes of movement (X, Y and Z). The linkages for two of these axes (X and Y) are incorporated into the joystick base, and the linkage for the remaining axis (Z) is uniquely incorporated into the joystick handle.

The mechanical linkage of the two lower axes has been designed to provide high strength and long life. The primary load carrying members of the two lower axes are manufactured from high strength metal. This allows the joystick to endure much higher twisting forces than previous joystick designs have allowed. The surfaces that are exposed to rotation and wear are preferably made of self-lubricating materials for a non-greasy feel, but may have lubrication added if desired.

A first axis (X-axis) in the base of the present invention is in the form of a durable rotatable metal rod or axle which extends across the square (or rectangular) base of the joystick assembly. One end of this axle extends through a wall of the base and engages a tab on a first potentiometer that is snap fit onto this outside wall of the base. The axle includes a central slotted opening for receiving the end of the joystick shaft such that movement of the handle along the X-axis rotates the axle, and moves the first potentiometer tab.

A second axis (Y-axis) is provided in the base perpendicular to the first axis. The second axis is in the form of a durable modified axle having a bowed central section that curves around the axle of the first axis. The second axle is preferably made of durable rigid plastic (to allow easy snap fit attachment around the first axle), but can also be made of metal. One end of the second axle extends through a different wall of the base and engages a tab on a second potentiometer that is snap fit onto the outside of this wall of the base. The curved section of the second axle also includes an opening for receiving the end of the joystick shaft such that movement of the handle along the Y-axis rotates the second axle, and moves the second potentiometer tab.

All of the components of the base are designed to assemble with great ease in a minimum amount of time. In particular, the two potentiometers are snapped into place, eliminating the need for any threaded fasteners. The joystick is designed to interface electronically with software that is designed to compensate for out of tolerance conditions of the potentiometer signal, allowing the potentiometers to be fixedly mounted without any need for adjustments. The base that houses the two lower axes is designed to fit within the streamlined confinement of a keyboard, and is also suitable for use as a stand alone unit such as with a video game or the like.

The unique handle of the present invention is designed to consistently and reliably transmit rotational or twisting motion along the Z-axis without destruction or deterioration of the joystick mechanism. The handle of the joystick includes a rigid hollow cylindrical sleeve around which a slightly deformable plastic or rubberized grip is attached. The grip includes external longitudinal ribs that are comfortable to the touch. A rigid cover (preferably a press-fit metallic cap having a powder or rubberized outer coating) is attached to the top of the sleeve. The sleeve, grip and cover form a single unit or "twist handle." An unique inner body is slidably disposed inside the hollow sleeve of the twist handle, such that the twist handle is able to slidably rotate around the inner body.

The inner body is formed so as to receive a horizontally positioned third potentiometer, the wires from which extend out from the inner body through a small opening at the bottom of the inner body and travel alongside the shaft into the joystick base. The third potentiometer is held in place inside the inner body using a snap bracket such that the potentiometer control tab extends axially outward towards the cap of the twist handle. A slot on the inside of the cap of the twist handle is placed such that it engages the tab of the third potentiometer to impart rotational motion to the potentiometer. The inside of the cap is also provided with a pair of limiting stops, and the inner body is provided with a pair of corresponding arcuate slots. When assembled, preferably through press fitting which avoids. the use of any threaded fasteners, the slot inside the cap engages the potentiometer tab, and the stops fit into the arcuate slots. Rotational movement of the twist handle is transmitted to the potentiometer tab and transmitted through wires to the joystick base. The arcuate slots define the amount of rotational distance through which the twist combination may rotate, the ends of the slots preventing the stops from traveling further. Thus, when a stop reaches the end of its corresponding slot, the twist handle is prevented from further rotational motion. A small torsion spring is provided inside the cap to return it to center when rotational pressure is released. The torsion spring rides on self-lubricating surfaces, allowing for a smooth and consistent return action of the twist combination. The spring itself is lubricated with a dry film lubricant.

Should the user exert further force, it is transmitted through the inner body to the rod and into the joystick base where it is resisted by the durable base construction described herein. Thus, the tabs and slots in the twist handle cover and inner body prevent excess rotational movement of the twist handle thereby eliminating any danger of damaging the potentiometer located inside the inner body, or of twisting or breaking the wires leading from the potentiometer inside the twist handle.

The shaft of the handle is inserted into the joystick base such that it passes through the openings of both the first and second axles. A strong compression spring is provided around the shaft between the inner body of the handle and a circular opening in the base, the compression spring exerting pressure against both the perimeter of the opening and the lower edge of the inner body. This pressure causes the shaft (and joystick handle) to return to an upright, centered position when not in use. The joystick base, and particularly the peripheral area around the opening for the shaft, is made of low-friction material and/or impregnated with lubricating materials. A low friction washer is provided between the compression spring and the shaft opening to reduce wear and provide for smoother operation.

It is therefore a primary object of the present invention to provide a durable and reliable joystick mechanism that is capable of withstanding considerable operator-induced motion and stress along each of the X, Y and Z-axes without failure, while also providing precise motion detection signals for each of the three axes for use by a computer system.

It is also a primary object of the present invention to provide a durable joystick mechanism that is capable of withstanding considerable operator-induced twisting and turning along the Z-axis without failure, while also providing precise motion detection signals for this axis for use by a computer system.

It is also an important object of the present invention to provide a durable and reliable joystick having two potentiometers mounted in the joystick base for detection of the angle and inclination of the joystick along the X and Y axes, and a third potentiometer uniquely and protectively mounted inside the joystick handle for detecting rotation around the Z-axis, thereby providing precision output signals for all three axes.

It is also an important object of the present invention to provide a joystick mechanism having a potentiometer fixedly mounted to the joystick shaft and deployed inside the rotatable handle of the joystick for transmitting signals generated by rotational movement of the handle around the Z-axis, in which the potentiometer and the wires leading from it are protected from damage by rotation-limiting stops between the rotatable handle and the shaft.

It is also an important object of the present invention to provide a joystick mechanism having rotation-limiting stops inside the rotatable handle of the joystick to restrict rotational movement of the joystick handle relative to the joystick shaft.

It is another object of the present invention to provide a joystick mechanism having fixedly mounted potentiometers for detection of motion along the X and Y axes.

It is another object of the present invention to provide a comfortable and easy to use joystick mechanism that is relatively grease-free.

It is another object of the present invention to provide a durable, reliable joystick mechanism that may be employed in a computer keyboard or as a stand-alone unit.

It is another object of the present invention to provide a durable, reliable joystick mechanism for providing precise motion detection signals for the X, Y and Z-axes for use by a computer system controlling a surveillance camera or the like.

Additional objects of the invention will be apparent from the detailed descriptions and the claims herein.

DETAILED DESCRIPTION OF A PREFERRED EMBODIMENT

Figure 1:
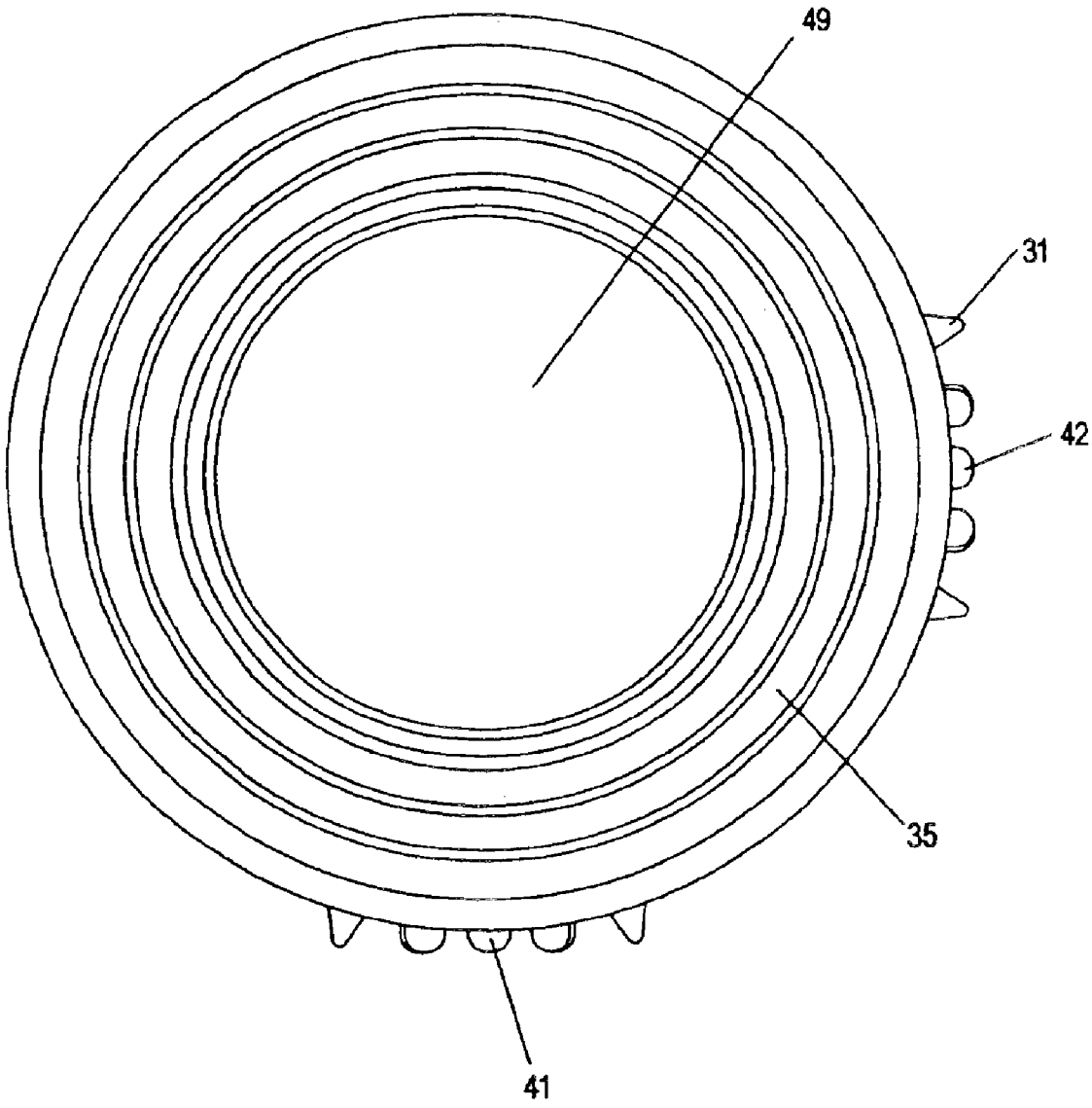
FIG. 1 is a top plan view of the improved joystick of the present invention.
Figure 2:
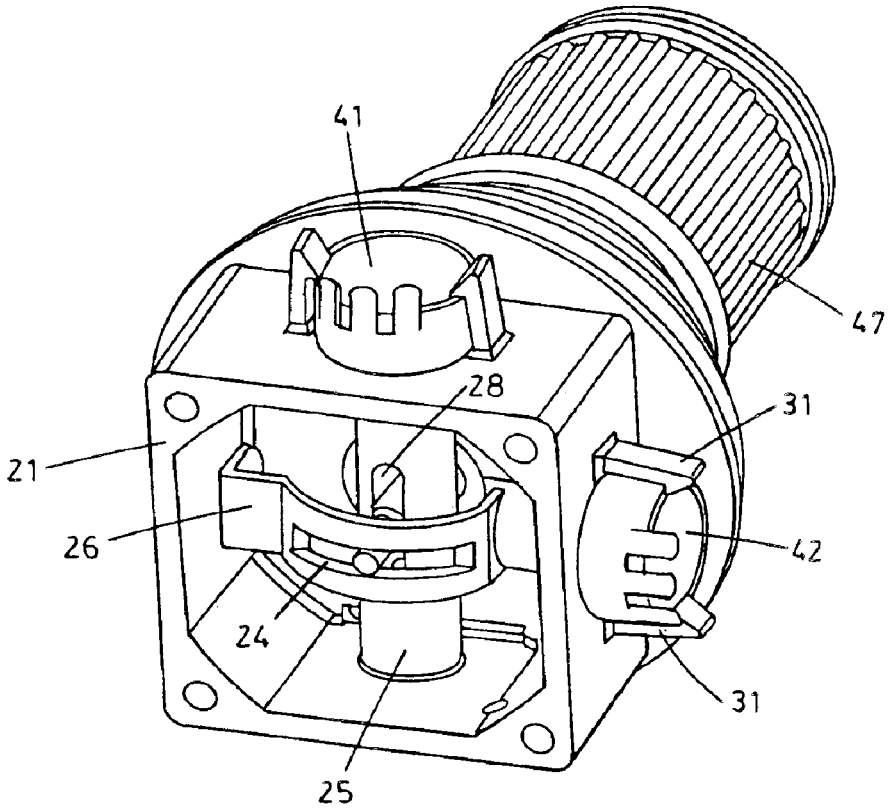
FIG. 2 is a bottom isometric view of the improved joystick of the present invention.
Figure 3:
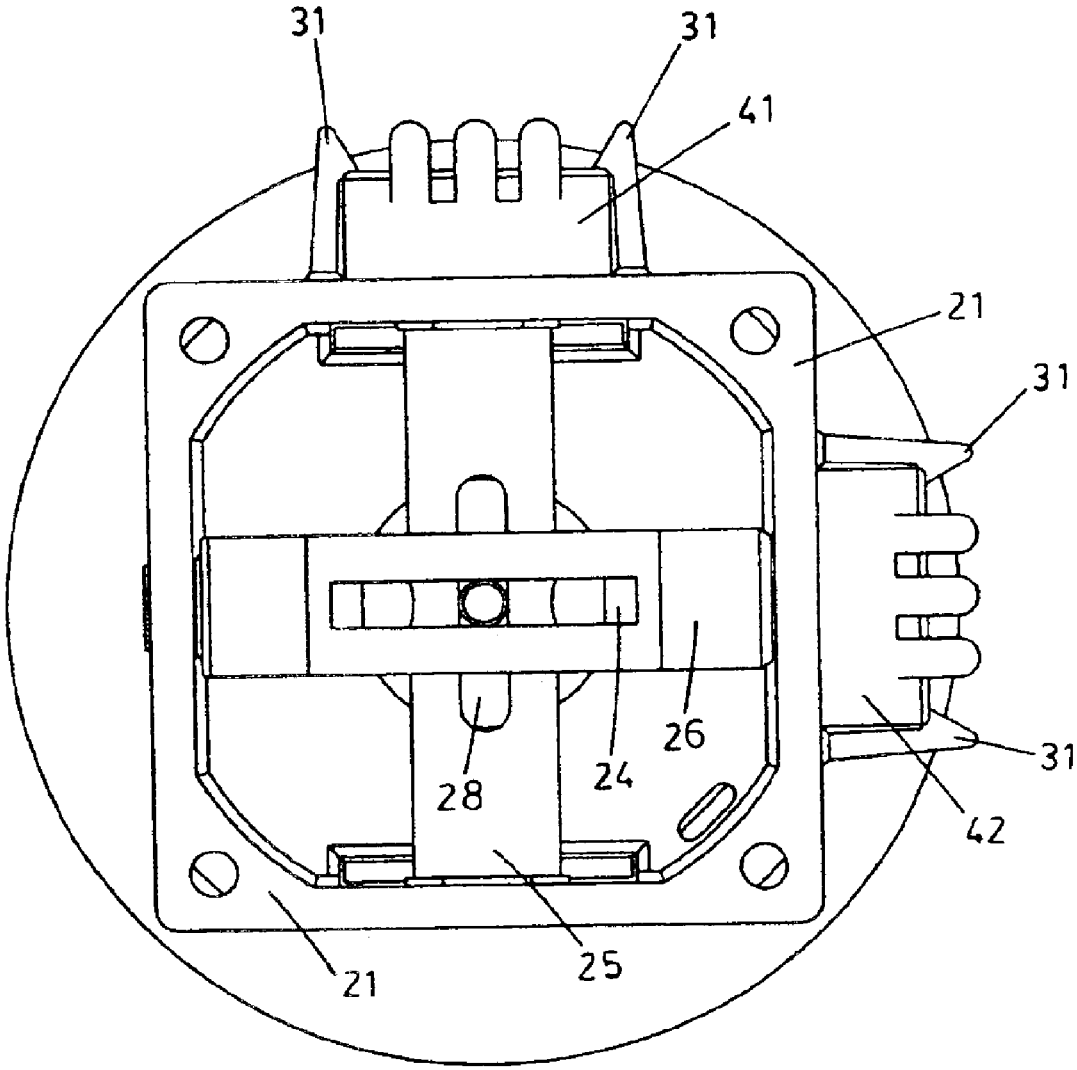
FIG. 3 is a bottom plan view of the improved joystick of the present invention.
Figure 4:
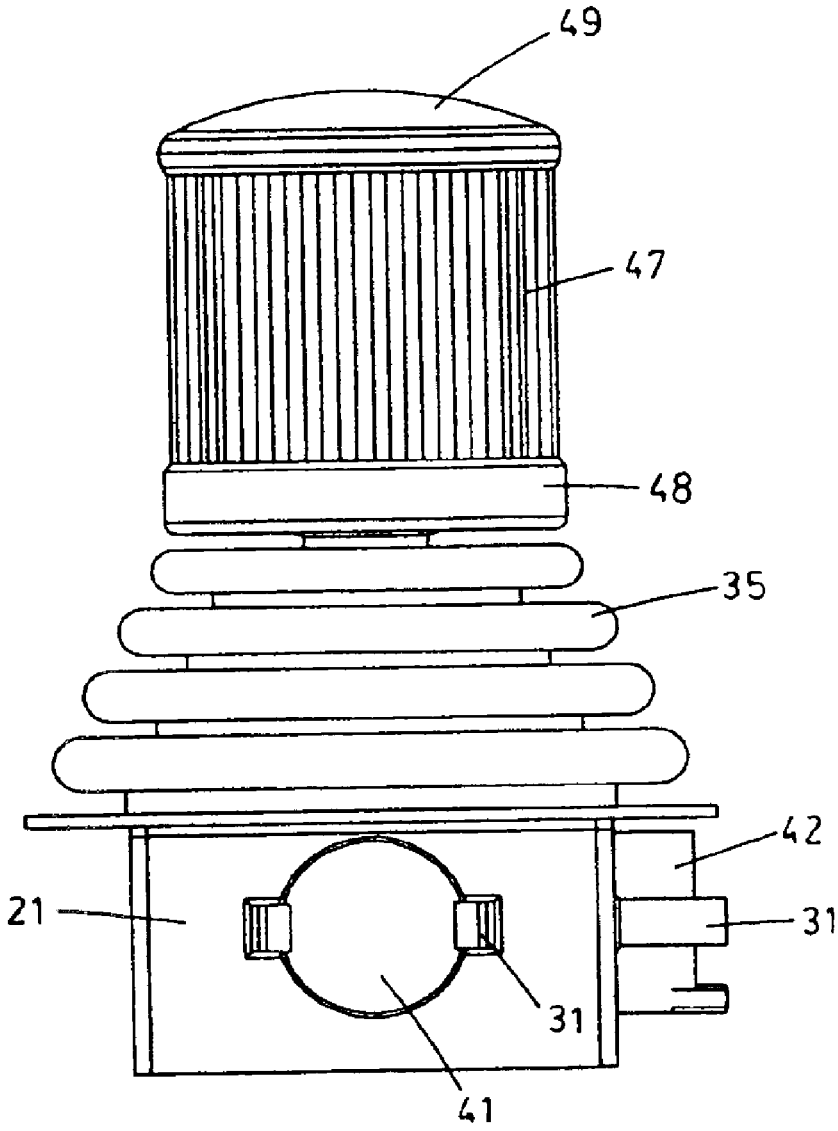
FIG. 4 is a front elevational view of the present invention.
Figure 5:
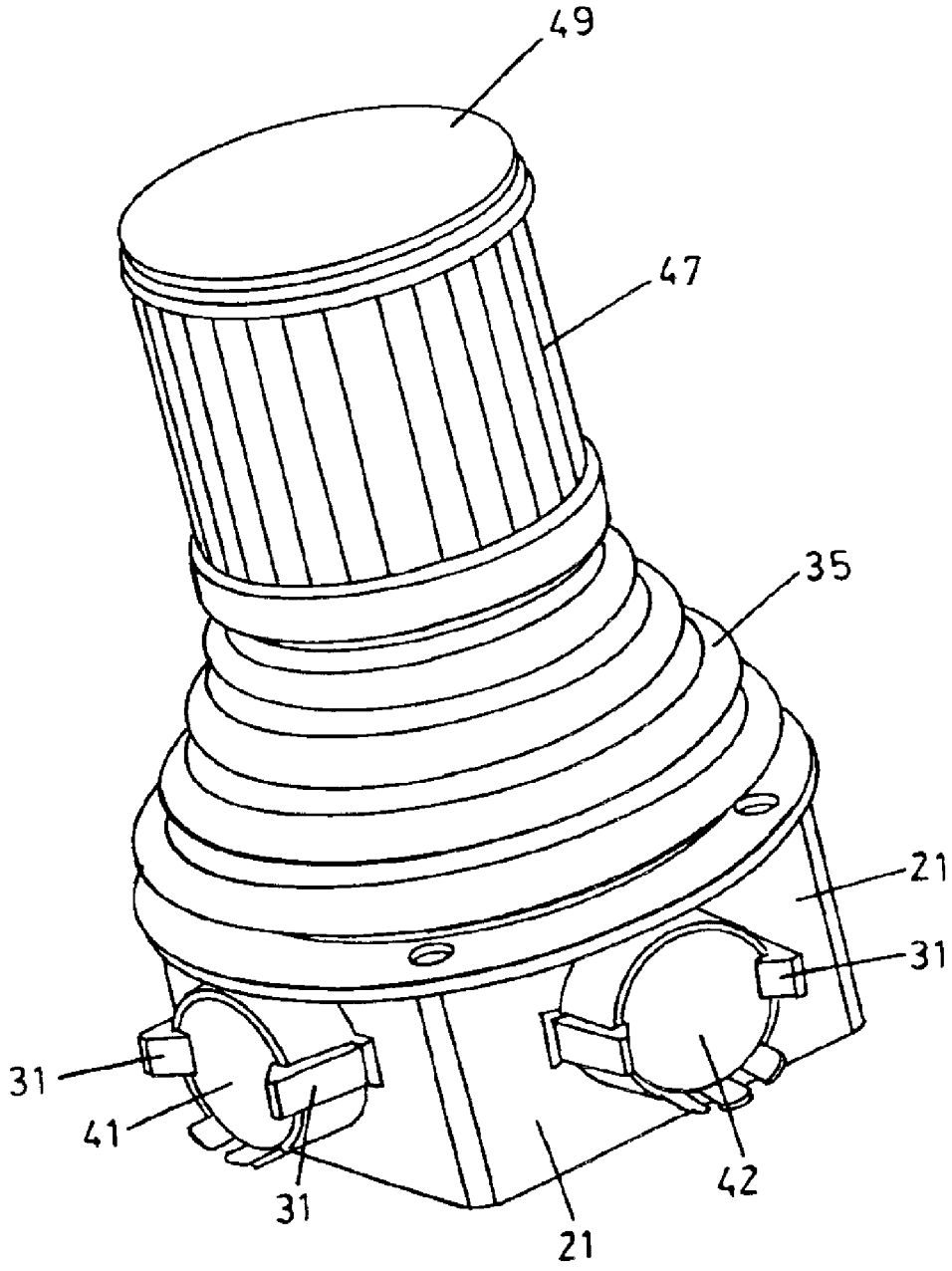
FIG. 5 is a front perspective view of the present invention.
Figure 6:
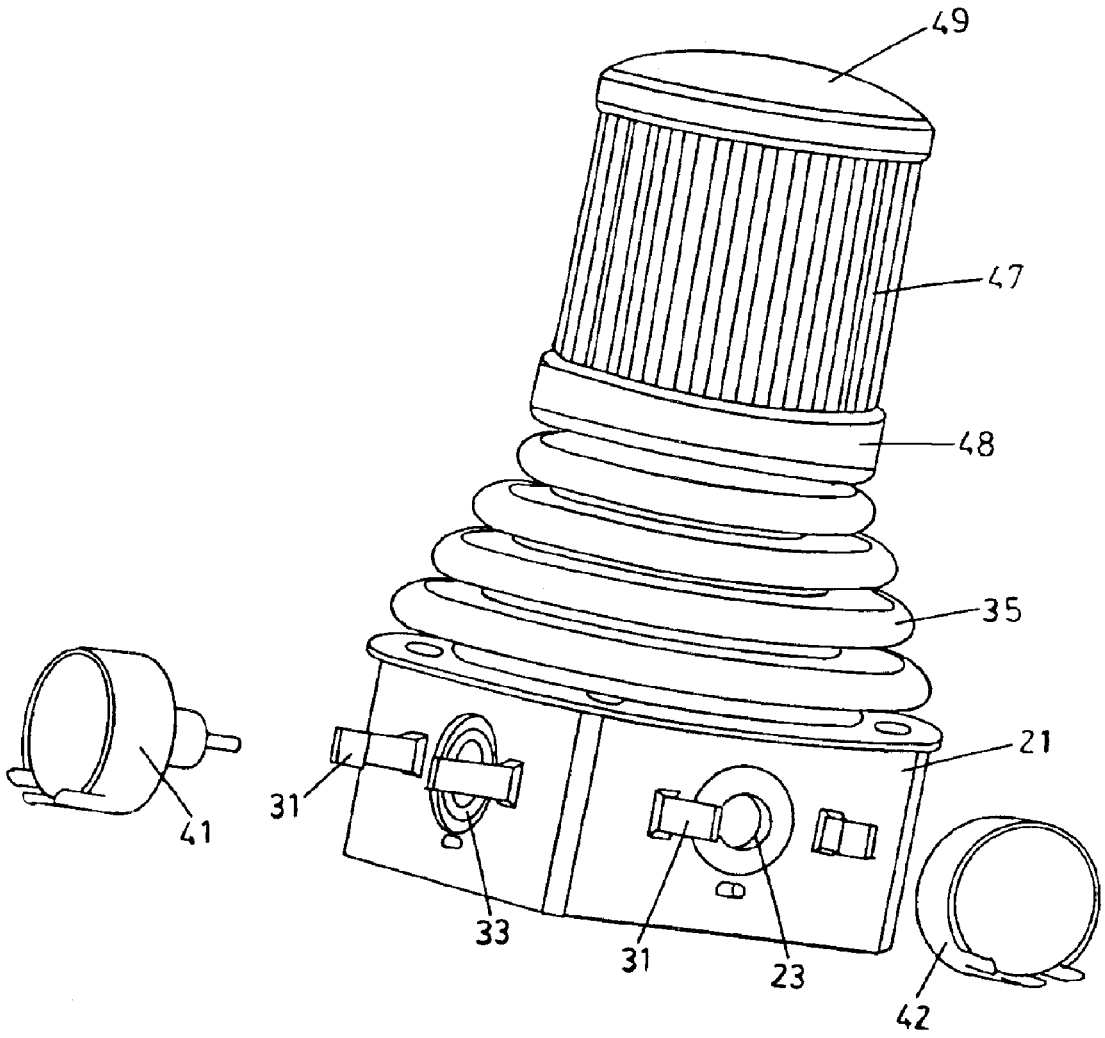
FIG. 6 is a partially exploded view of the potentiometers of the present invention.
Figure 8:
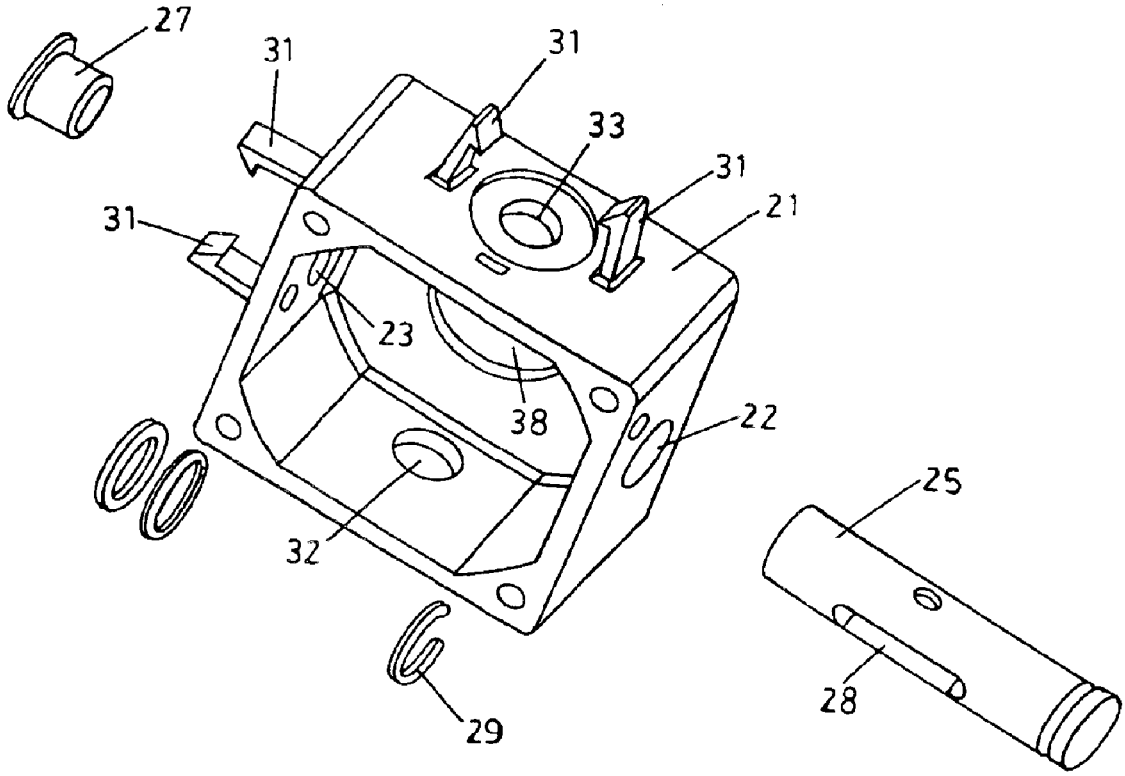
FIG. 8 is an exploded view of the base of the present invention.
Figure 9:
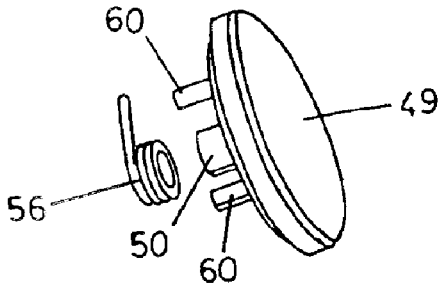
FIG. 9 is a view of the joystick cap and spring assembly of the present invention.
Figure 10:
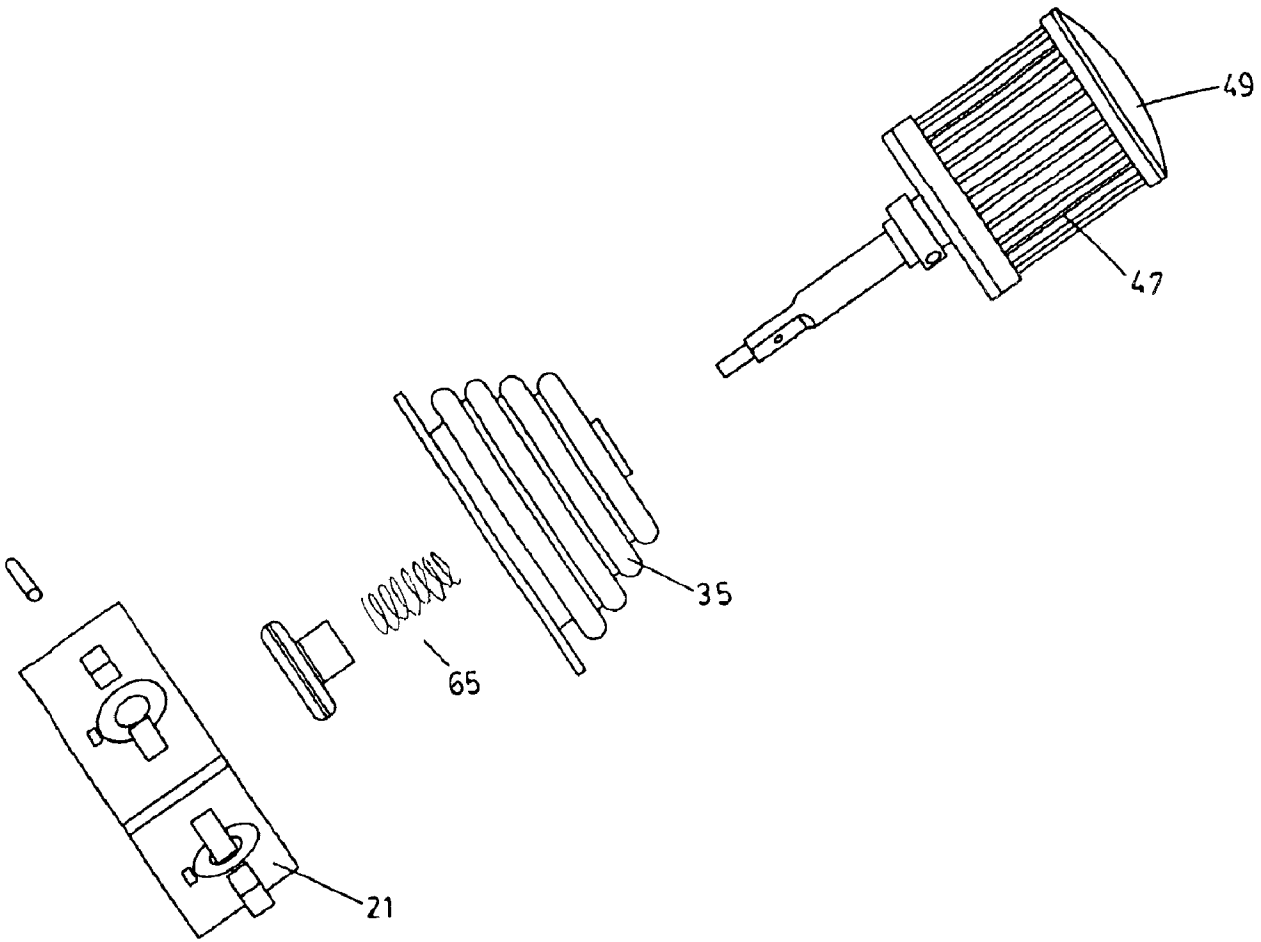
FIG. 10 is a partially exploded view of the present invention.

Referring to the drawings wherein like reference characters designate like or corresponding parts throughout the several views, and referring particularly to FIGS. 2, 3 and 8, it is seen that the base assembly of the present invention includes a square or rectangular base member 21 made of self-lubricating plastic or other low friction material. A pair of openings 22, 23 on opposite sides of base 21 are provided for receiving a rotatable rod or axle 25. A bearing 27 made of self-lubricating material is provided for holding rod 25 in opening 23, and a snap ring 29 is used to hold rod 25 in opening 22. Rod 25 includes an elongated central slotted opening 28 for receiving the shaft 53 of the joystick handle. Deflection of shaft 53 causes rod 25 to rotate. One end of rod 25 is engaged with a first potentiometer 41 that is snap fit into place over opening 23 using tabs 31. Thus, rotational movement of rod 25 caused by movement of the joystick shaft 53 along the X-axis will be imparted to potentiometer 41 and transmitted to the system.

A second pair of openings 32, 33 are provided on the remaining opposite sides of base 21 are provided for receiving a second rotatable axle 26. Axle 26 is mounted perpendicular to axle 25, and has a bowed central section to fit around axle 25 as shown in FIG. 2. Axle 26 includes an elongated central slotted opening 24 that also receives shaft 53 of the joystick. Deflection of shaft 53 causes axle 26 to rotate. One end of axle 26 is engaged with a second potentiometer 42 that is snap fit into place over opening 33 using tabs 31. Thus, rotational movement of axle 26 caused by movement of joystick shaft 53 along the Y-axis will be imparted to potentiometer 42 and transmitted to the system.

Figure 7:
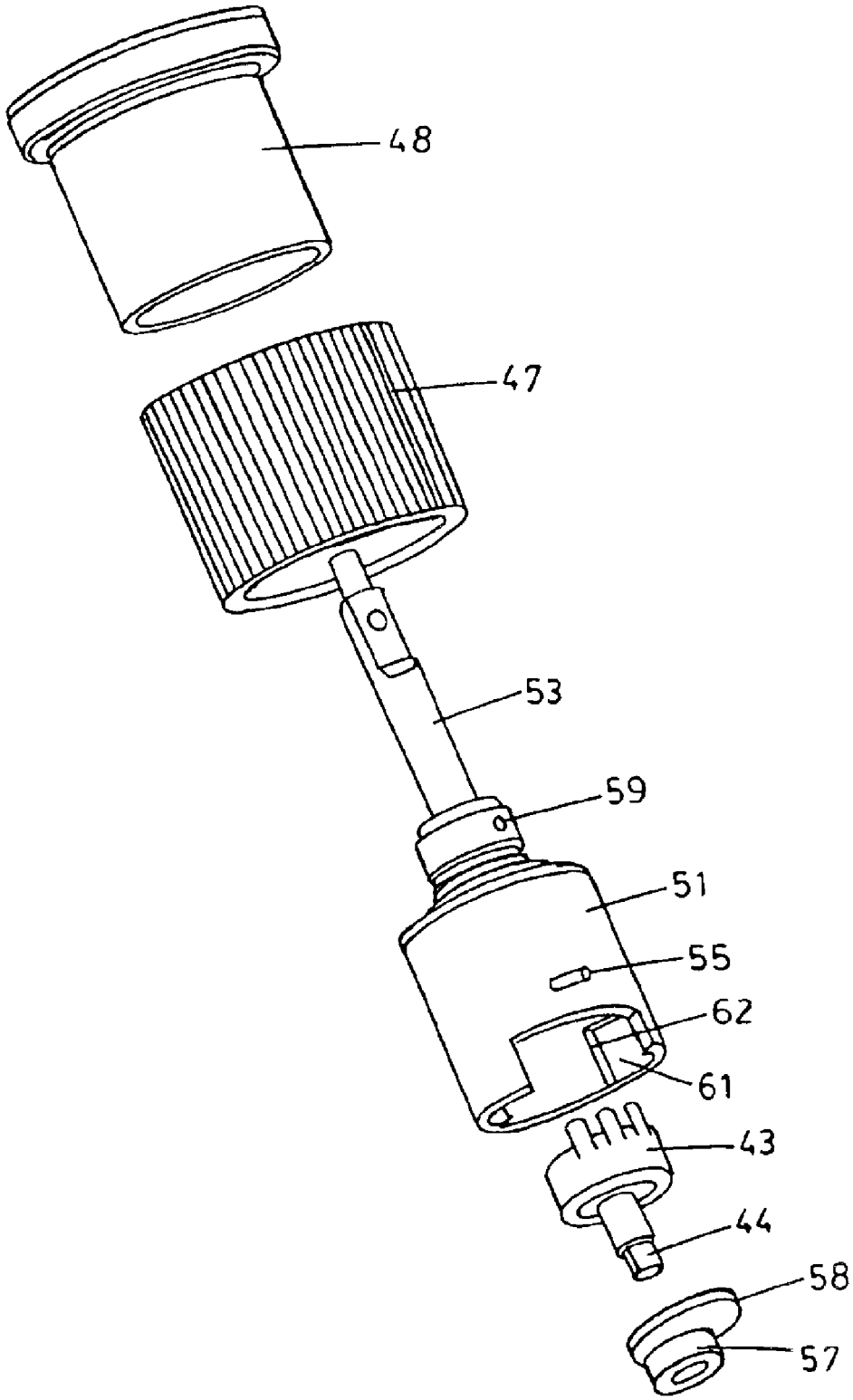
FIG. 7 is an exploded view of the internal assembly of the joystick handle of the present invention.
Figure 7A:
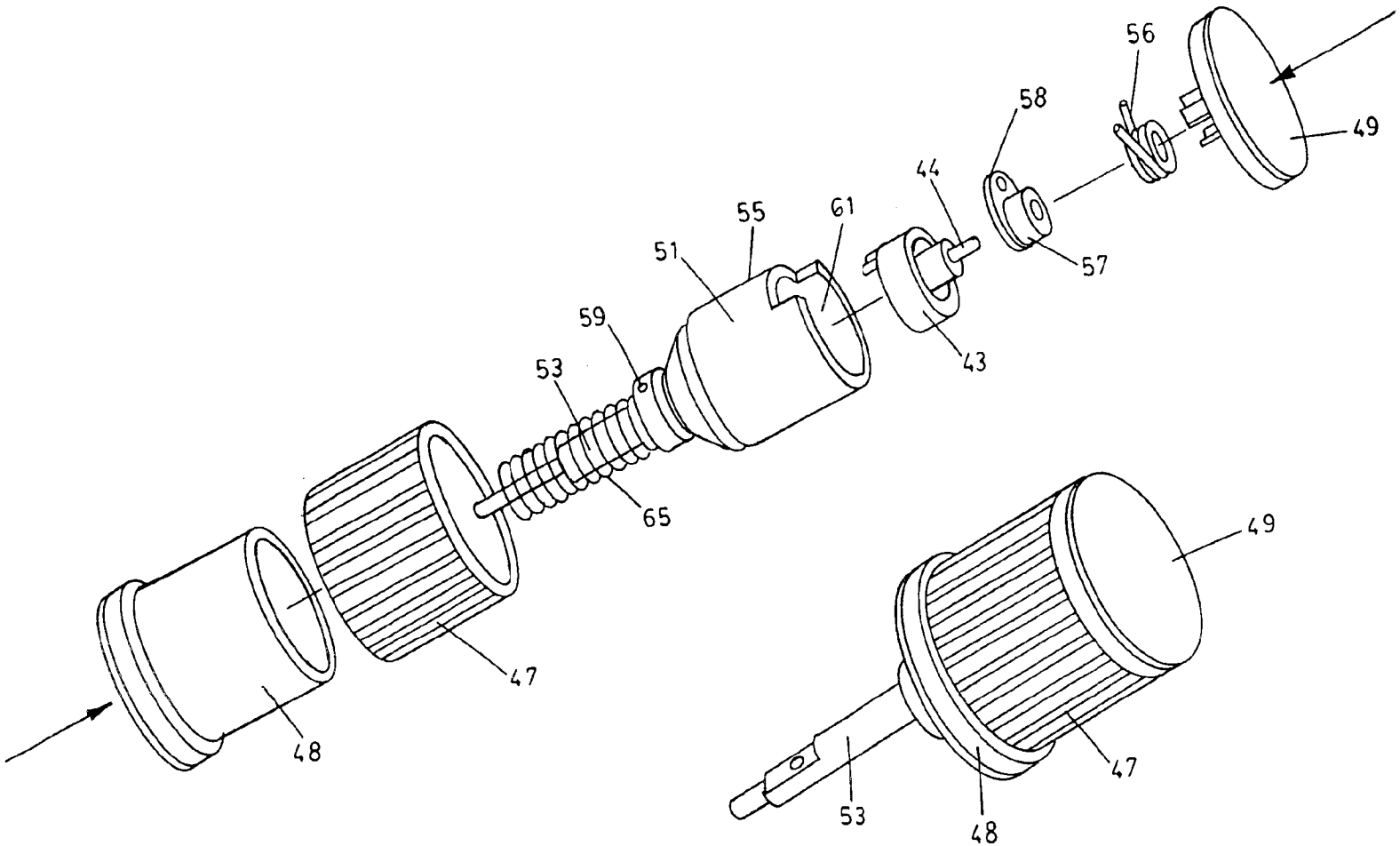
FIG. 7A is a detailed view of the internal joystick handle assembly.
Figure 7B:
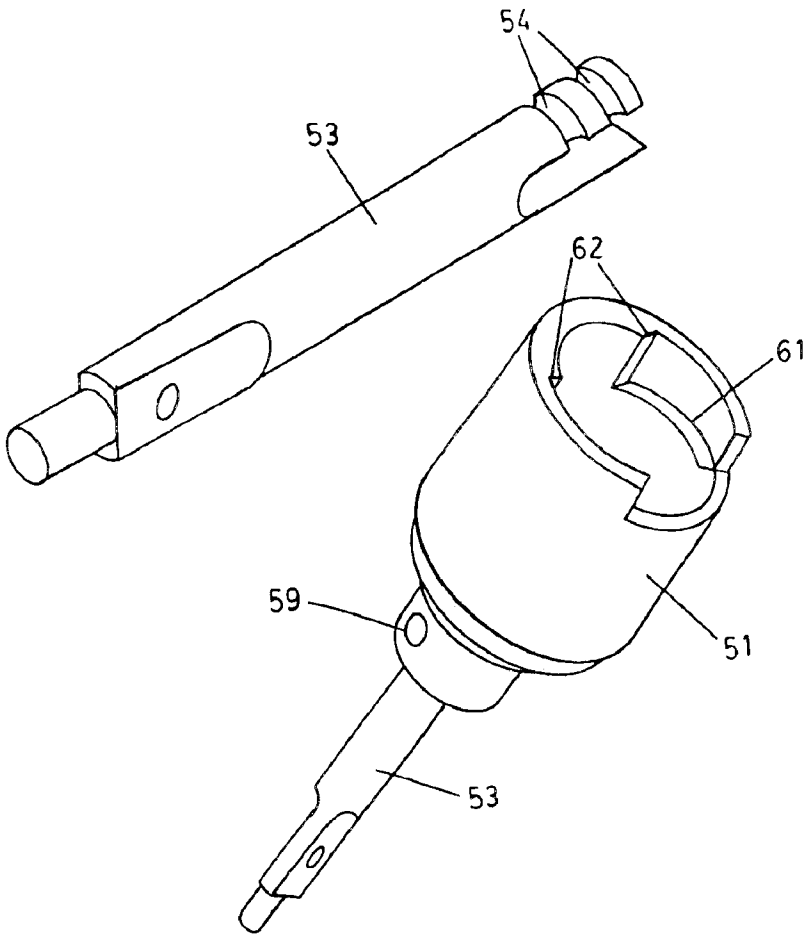
FIG. 7B is another detailed view of the internal joystick handle assembly.

Turning to FIGS. 7, 7A and 7B, it is seen that the handle of the present invention is made up of a unique internal non-rotating section which houses a third potentiometer 43, and an external rotatable section or handle. The internal section includes a mainstick having an inner cylindrical body 51 attached to a shaft 53. Shaft 53 is preferably made of metal, and body 51 is preferably made of injection molded plastic. In such a preferred embodiment, grooves 54 provided on shaft 53 allow for better bonding adhesion between body 51 and shaft 53 (see FIG. 7B). However, shaft 53 and body 51 may be provided in a single molded integrated unit. Body 51 includes a hollow central section into which the third potentiometer 43 fits. A retainer 57 holds potentiometer 43 into place inside body 51, with tab 58 of retainer 57 engaging opening 55 in body 51. The wires from potentiometer 43 pass through opening 59 at the bottom of body 51, and travel along shaft 53 into base 21. The operational tab 44 of potentiometer 43 protrudes axially outward through retainer 57.

Inner body 51 is cylindrical in form and is permanently attached to shaft 53 that extends out through the bottom center of the twist handle (described below) and into the joystick base. Shaft 53 is preferably made of metal in order to provide greater strength in a smaller cross section. The inner body 51 is preferably injection molded to allow for easy formation of the complex shapes required. If inner body 51 is molded onto the shaft for permanent adhesion, the shaft should preferably have grooves 54 to provide resistance to separation of the molded plastic for better bonding. See FIG. 7B. The outer cylindrical surface of the inner body 51 is preferably impregnated with a self-bearing or lubricating material such as silicon so as to facilitate smooth low-friction contact with the cylindrical interior of twist body 48.

The external rotatable section of the joystick is made up of a hollow cylindrical sleeve or twist body 48 that is surrounded by a rubberized sleeve 47 having comfortable longitudinal ribs located thereon. Twist body 48 slidably surrounds inner body 51, with shaft 53 extending out through the lower open end of twist body 48. A cap 49 is attached to the opposite end of twist body 48 (see FIG. 7A) such that a rotatable section (twist handle) made up of body 48, sleeve 47 and cap 49 surrounds inner body 51. Cap 49 is provided with a slot 50 that engages the outwardly extending operational tab 44 of potentiometer 43 when the rotatable section 47-48-49 is fitted over inner body 51. In this way, rotational movement (twisting on the Z axis) of the rotatable section is imparted to potentiometer 43 and transmitted to the system. A small torsion spring 56 is provided inside the cap to return it to center when rotational pressure is released.

It is to be appreciated that the twist handle 47-48-49 may be in any suitable configuration that is slidably disposed to encapsulate the inner body 51. For example, the rubberized grip 47 may be incorporated into the cap 49; or the cap 49 may be integrated into the twist body 48 as a single unit with a separately removable bottom panel (having an opening therein for the shaft 53), with the grip 47 being engaged over the integrated body.

A pair of stops 60 are provided on the inside of cap 49. Internal body 51 includes a pair of arcuate slots 61 each slot having an end wall 62. Slots 61 receive the stops 60 of cap 49. End walls 62 limit the movement of stops 60, thereby limiting the range of movement of the rotatable section along the Z-axis and preventing damage from over-rotation.

A compression spring 65 is provided along shaft 53 between the lower end of body 51 and shaft opening 38 in base 21. A flexible rubberized shroud or boot 35 is provided around shaft 53 to protect the wires leading from potentiometer 43, and to prevent external contaminants from entering the joystick mechanism.

In the preferred embodiment, the major load bearing components (such as shaft 53, twist body 48, rod 25, and axle 26) are manufactured out of metal which has greater strength than plastic, thereby enabling the joystick to withstand much greater forces. The design of the twist handle has much stronger components and will not allow the wires leading from the potentiometer inside to break from excessive twisting. The present design eliminates the use of any threaded fasteners for mounting the potentiometers. Instead the potentiometer bodies 41 and 42 are snap mounted to the base and held in place by use of tabs 31 that lock the potentiometers onto the base. This prevents rotation of the potentiometer body that might otherwise cause the joystick to go out of calibration. Finally, the present invention uses a compression spring along the shaft of the joystick handle to return the handle to center along the X and Y-axes. A single compression spring is more reliable than a pair or plurality of tension springs, and does not require any mounting hooks.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A multifunctional joystick controller comprising:

a. a shaft;

b. a base for receiving the distal end of said shaft and movably supporting said shaft, said base including an operation detection mechanism for detecting the incline and angle of said shaft on a first axis and a second axis;

c. a housing fixedly attached to the proximal end of said shaft, said housing having a recessed central section therein for receiving a potentiometer, and an internal channel communicating between said recessed central section and the proximal end of said shaft for receiving wires traveling from said potentiometer along said shaft to said base;

d. a handle mechanism rotatably deployed around said housing such that said handle engages an operable tab on said potentiometer for imparting rotational movement thereto, and e. a slot in said housing and a tab in said handle corresponding to said slot for limiting the rotation of said handle relative to said housing wherein said operation detection mechanism comprises:

a. a first rotatable axle mounted inside said base, said axle having an axial central slotted opening therein for receiving the distal end of said shaft;

b. a second rotatable U-shaped axle mounted inside said base adjacent and perpendicular to said first axle, said second axle also having an axial central slotted opening therein for receiving the distal end of said shaft;

c. a first potentiometer mounted on the outside of said base in communication with said first rotatable axle for detecting motion along the first axis, and d. a second potentiometer mounted on the outside of said base in communication with said second rotatable axle for detecting motion along the second axis.

2. The joystick controller of claim 1 wherein a retainer is provided for holding said potentiometer in said recessed central section, and a torsion spring is provided adjacent to the operable tab of said potentiometer for returning said rotatable handle to a default position in the absence of operator movement.

3. The joystick controller of claim 1 wherein a compression spring is provided along said shaft between said base and said cylindrical housing for returning said shalt to a default position in the absence of operator movement.

4. The joystick controller of claim 3 wherein a flexible protective shroud is provided around said shaft between said handle and said base.

5. The joystick controller of claim 4 wherein said first axle, said second axle and said shaft are all made of metal.

6. The joystick controller of claim 4 wherein said shaft and said housing are integrated into a single rigid piece.

7. The joystick controller of claim 1 wherein the rotational movement imparted to said potentiometer is about a third axis.

8. The joystick controller of claim 7 wherein said first axis is the X-axis, said second axis is the Y-axis, and said third axis is the Z-axis.

9. A multifunctional joystick controller comprising:

a. a shaft;

b. a generally rectangular base for receiving the distal end of said shaft and movably supporting said shaft, said base including an operation detection mechanism for detecting the incline and angle of said shaft in the X- and Y-directions, said operation detection mechanism comprising:

i a first rotatable axle mounted inside said base, said axle having an axial central slotted opening therein for receiving the distal end of said shalt;

ii. a second rotatable U-shaped axle mounted inside said base adjacent and perpendicular to said first axle, said second axle also having an axial central slotted opening therein for receiving the distal end of said shalt;

iii. a first potentiometer mounted on the outside of said base in communication with said first rotatable axle for detecting motion along the X-axis; and iv. a second potentiometer mounted on the outside of said base in communication with said second rotatable axle for detecting motion along the Y-axis;

c. a generally cylindrical housing fixedly attached to the proximal end of said shaft, said housing having a recessed slot for receiving a potentiometer mounted in said slot, and an internal channel communicating between said slot and the proximal end of said shaft for receiving wires traveling from said potentiometer along said shaft to said base;

d. a handle mechanism rotatably deployed around said cylindrical housing such that said handle engages an operable tab on said potentiometer for imparting rotational movement thereto; and e. at least one slot in said cylindrical housing and at least one tab in said handle corresponding to said slot for limiting the rotation of said handle relative to said housing.

10. The joystick controller of claim 9 wherein a compression spring is provided along said shaft between said base and said cylindrical housing for returning said shaft to a default position in the absence of operator movement.

11. The joystick controller of claim 9 wherein a flexible protective shroud is provided around said shaft between said handle and said base.

12. The joystick controller of claim 9 wherein said first axle, said second axle and said shaft are all made of metal.

13. The joystick controller of claim 9 wherein said shaft and said housing are integrated into a single rigid piece.

14. A manually manipulated joystick controller comprising:

a. a shaft having proximal and distal ends;

b. a base for receiving the distal end of said shaft and movably supporting said shaft; and c. an operation detection mechanism in said base operably associated with said shaft for detecting the incline and angle of said shaft on a first axis and a second axis, said operation detection mechanism comprising:

1. a first rotatable axle mounted inside said base, said axle having an axial central slotted opening therein for receiving the distal end of said shaft;
2. a second rotatable U-shaved axle mounted inside said base adjacent and perpendicular to said first axle, said second axle also having an axial central slotted opening therein for receiving the distal end of said shaft;
3. a first potentiometer mounted on said base in communication with said first rotatable axle for detecting motion along the first axis; and
4. a second potentiometer mounted on said base in communication with said second rotatable axle for detecting motion along the second axis wherein a housing is fixedly attached to the proximal end of said shaft, said housing having a recessed central section therein for receiving a third potentiometer, and wherein a handle mechanism is rotatably deployed around said housing such that said handle engages an operable tab on said potentiometer for imparting rotational movement thereto about a third axis and wherein a slot is provided in said housing and a tab is provided in said handle corresponding to said slot for limiting the rotation of said handle relative to said housing.

15. The joystick controller of claim 14 wherein said first axis is the X-axis, said second axis is the Y-axis, and said third axis is the Z-axis.

16. The joystick controller of claim 14 wherein a retainer is provided for holding said third potentiometer in said recessed central section, and a torsion spring is provided adjacent to the operable tab of said third potentiometer for returning said rotatable handle to a default position in the absence of operator movement.

* * * * *

UNITED STATES PATENT AND TRADEMARK OFFICE

CERTIFICATE OF CORRECTION

PATENT NO. : 6,892,597 B2
DATED : May 17, 2005
INVENTOR(S) : Erik Tews

It is certified that error appears in the above-identified patent and that said Letters Patent is hereby corrected as shown below:

Title page,
Item [60], Related U.S. Application Data, insert the following:
-- [60] This application is a Continuation-in-Part of 29/145,777. --.

Column 1,
Line 3, insert -- This application is a Continuation-in-Part of 29/145,777. --.

Column 8,
Lines 12, 37 and 42, delete “shalt” and insert -- shaft --.

Column 9,
Line 20, delete “U-shaved” and insert -- U-shaped --.

Signed and Sealed this

Twenty-ninth Day of November, 2005

JON W. DUDAS
*Director of the United States Patent and Trademark Office*